US006902148B1

(12) United States Patent
Spencer

(10) Patent No.: US 6,902,148 B1
(45) Date of Patent: Jun. 7, 2005

(54) SAFETY JACK

(76) Inventor: Chris Spencer, 3031 Eagle Nest La., Humble, TX (US) 77396

( * ) Notice: Subject to any disclaimer, the term of this patent is extended or adjusted under 35 U.S.C. 154(b) by 0 days.

(21) Appl. No.: 10/718,448

(22) Filed: Nov. 19, 2003

(51) Int. Cl.[7] ..... B66F 7/08
(52) U.S. Cl. ..... 254/93 H; 254/89 H; 254/2 B
(58) Field of Search ..... 254/93 H, 89 H, 254/93 R, 93 A, 2 B, 7 B, 8 B, 133 R

(56) References Cited

U.S. PATENT DOCUMENTS 3,567,183 A * 3/1971 Voss ..... 254/93 H
4,042,202 A 8/1977 Molinari
4,479,634 A 10/1984 Blatz
5,228,651 A * 7/1993 Warner ..... 254/94
5,984,270 A * 11/1999 Hussaini et al. ..... 254/8 B
6,027,102 A 2/2000 Krupa
6,322,062 B1 11/2001 Conn et al.
6,416,039 B1 * 7/2002 Pietrusynski ..... 254/8 B
6,443,413 B1 9/2002 Hawkins et al.
6,464,192 B1 * 10/2002 Gibbs, Jr. ..... 248/352

* cited by examiner

*Primary Examiner*—Lee D. Wilson
(74) *Attorney, Agent, or Firm*—Law Office of Craig Bohn; Craig F. Bohn

(57) ABSTRACT

The present invention is a safety jack having a propping mechanism comprised of a prop attached parallel to and jointly movable with the lifting arm, a storage well for receiving the prop in a retracted position, and a pin engagable with the prop to bias the prop and the body of the jack to prevent untimely lifting arm retraction.

18 Claims, 2 Drawing Sheets

SAFETY JACK

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention is generally related to lifting jacks and more specifically to jacks having a safety mechanism to prevent unanticipated movement from an extended position to a retracted position.

2. Description of the Related Art

A great variety of jacks are known in the field. Jacks are employed to lift items of substantial weight to include vehicles. In some instances, once an item is lifted it may be desired to maintain the item in the elevated position for an extended period while activity is conducted about the item. In these instances, there exists a hazard that the particular jack may lose lifting force engagement, permitting the weighty item to unexpectedly lower. This presents a particularly serious hazard to activity being conducted underneath the item. For this reason the field of art practices placing rigid supports or jack stands under items to prevent the item from lowering in case the jack loses lifting force.

The prior art possesses a variety of exemplary adjustable jacks and jack stands. The following are a few examples.

U.S. Pat. No. 4,042,202 issued to D. Molinari on Aug. 16, 1977, discloses a jack stand with a safety-locking device whereby a pin is positioned through a plurality of alignable corresponding holes in the shaft and the housing locking these members with respect to each other longitudinally. The pin is keyed so as to prevent withdrawal of the pin until rotated into an aligned position.

U.S. Pat. No. 4,479,634 issued to R. Blatz on Oct. 30, 1984, discloses a jackable stand comprising of a vertical post that projects upward normal to a base. A carriage is attached to the vertical post moveably along the length of the post. The post has receiver holes vertically spaced apart along a length of the post and extending through the post. The carriage and base are engageable by a jack that may employ mechanical advantage to progress the carriage along the length of the post. A pin is employed in a selected receiver hole to restrict movement of the carriage along the post.

U.S. Pat. No. 6,027,102 issued to Krupa on Feb. 22, 2000, discloses a hydraulic jack stand having a hydraulic bottle jack positionable on an elongated jack support comprising a tubular outer housing, a moveable cylindrical member, and a pin. The outer housing has a pin anchor receiver, such that the pin may be inserted through the outer housing. The moveable member has a plurality of receiver holes vertically spaced apart along a length that, with the moveable member inserted into the outer housing, may be selectively alignable with the anchor receiver such that the pin may be inserted through both a receiver hole and the anchor hole, fixing the outer housing and moveable member longitudinally.

U.S. Pat. No. 6,322,062 B1 issued to Conn et al. on Nov. 27, 2001, discloses a cabinet installation lifting system comprising a jack and a pair of extendable supports, wherein said supports each comprise a tubular outer housing having an pin anchor receiver, a moveable cylindrical member having a plurality of receiver holes vertically spaced apart along a length that, with the moveable member inserted into the outer housing, may be selectively alignable with the anchor receiver such that a pin may be inserted through both a receiver hole and the anchor hole, fixing the outer housing and moveable member longitudinally throughout the lifting range of the jack.

U.S. Pat. No. 6,443,413 B1 issued to Hawkins et al. on Sep. 3, 2002, discloses an adjustable jack stand having a ratchet and pawl height maintenance mechanism with a pin and hole mechanism wherein the holes in the post coordinate with the teeth in the post so that any engagement between the pawl and a tooth ensures that a pair of holes in the base and the post are aligned to receive a pin.

It would be an improvement to the art to provide a jack having a locking mechanism comprised of a prop exterior to the lifting arm, a storage well for receiving the prop in a retracted position, and a locking pin engagable with said prop to bias said prop and the body of the jack to selectively prevent lifting arm retraction.

BRIEF SUMMARY OF THE INVENTION

My invention is a jack having a housing, a lifting arm or ram, and a prop. The prop may comprise at least one segment extending from said bottle housing parallel with said ram. Another embodiment of a prop may be integrated into a lifting arm. The bottle housing comprises a storage area designed to receive the prop from the face from which the ram extends. A suitable storage area may comprise a well positioned around the circumference of the ram, having a width and depth suitable to receive the prop as the prop moves with the ram from an extended position primarily out of the well to a retracted position primarily contained in the well. The prop comprises at least one pin receptacle for engagement with a pin such that the engagement of said pin with said receptacle positions said pin to restrict retraction of said ram to within said housing by biasing between the engaged pin receptacle and the bottle housing adjacent to the outer edge of the well. In this manner such an inventive hydraulic jack may mechanically support a weight in an extended position, even if said jack were to lose hydraulic support of said ram.

DESCRIPTION OF THE INVENTION

Figure 1:
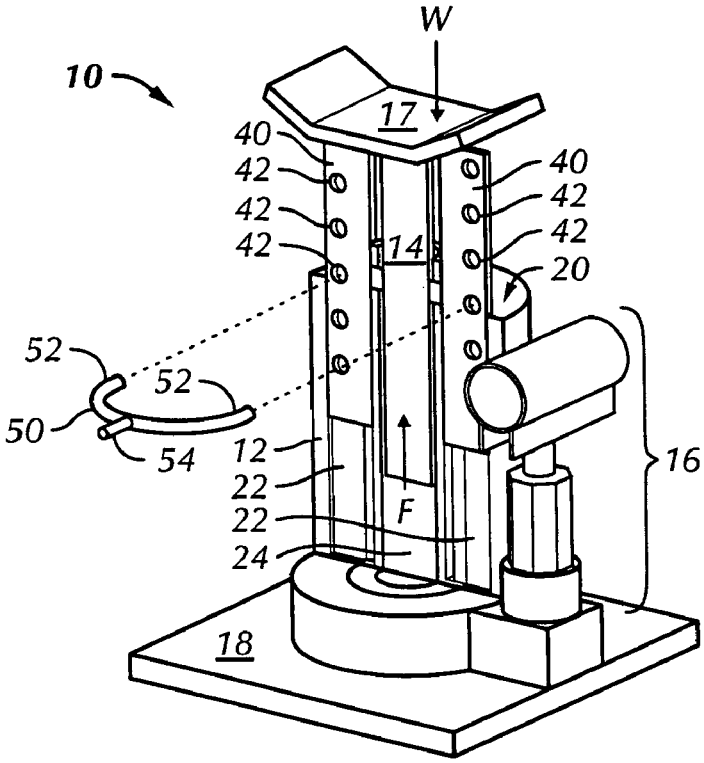
FIG. 1 is a partially cut-away perspective view of a bottle jack according to the present invention.
Figure 2:
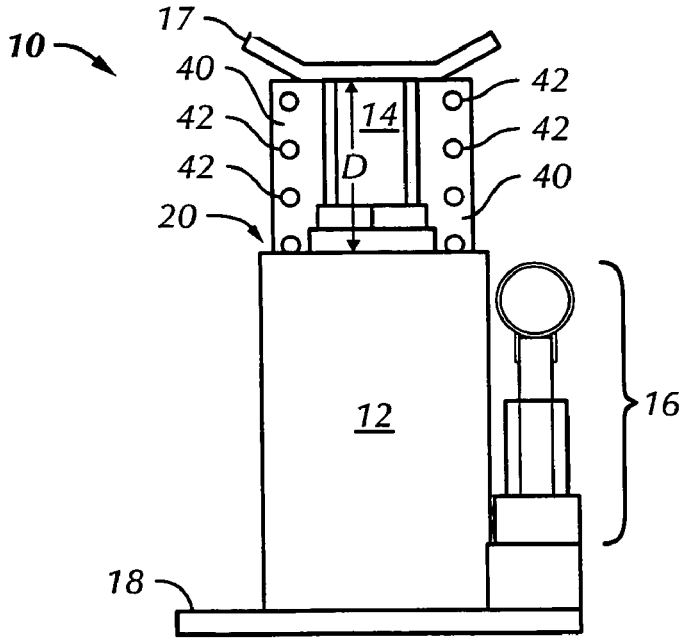
FIG. 2 is a frontal view of the jack depicted in FIG. 1.

Referring to FIGS. 1 and 2, an exemplary jack 10 is shown. Exemplary jack 10 may be a hydraulic bottle jack having a generally cylindrical jack housing 12 fixedly attached to a solid jack base 18 at one end, generally considered the bottom of jack 10. Other types of jacks known in the art may employ the inventive device. In the exemplary embodiment, jacking mechanism 16 is adjacent and operably linked to jack housing 12. Operation of jacking mechanism 16 creates hydraulic pressure from mechanical leverage through hydraulic fluid (not shown) within a fluid reservoir 24 contained in jack housing 12; a device and process known to the art. Also known to the art is the employment of this pressurized hydraulic fluid to work against the one end of ram 14 recessed into jack housing 12 causing ram 14 to controllably extend away from and retract toward jack housing 12 with substantial force F having substantial lifting capacity. In this fashion ram 14 may be described as being telescopically attached to jack housing 12. A jack shoe 17 is provided on the opposite end of ram 14 from jack housing 12, generally considered the top of jack 10, to provide an interface surface to an item to be jacked (not shown), as known in the art.

Prop 40 is attached to travel jointly with ram 14. Referring to FIGS. 1 and 2, exemplary jack 10 has a pair of elongated rigid members comprising prop 40 that are disposed on opposite sides of ram 14, oriented generally parallel to ram 14. As controlled by jacking mechanism 16, in lifting operation or lowering operation, the individual components of prop 40 correspondingly fit into storage wells 22 in jack housing 12, such that prop 40 and ram 14 may similarly and correspondingly both extend from in jacking mechanism 16 lifting operation and recess into jack housing 12 in jacking mechanism lowering operation.

Prop 40 possesses a series of pin receptacles 42 arranged spaced apart along the length of each component of prop 40 from the end recessed in housing 12 to the end adjacent to jack shoe 17. Pin receptacles 42 are disposed in prop 40 to permit the engagement of pin 50. In the exemplary embodiment, pin receptacles 42 are transverses perforations in prop 40. In the exemplary embodiment pin 50 is comprised of a pair of pin shafts 52 that extend in one direction with a pin handle 54 extending in the opposite direction. Pin 50 possesses a corresponding shape suited to engage corresponding pin receptacles 42 on prop 40. In the exemplary embodiment a pin receptacle 42 in one component of prop 40 and a corresponding pin receptacle 42 in the other component of prop 40 are positioned along prop 40 in order to extend a similar distance above housing upper surface 20 such that each of the pair of pin receptacles 42 may receive a corresponding pin shaft 52. In the exemplary embodiment, each pin shaft 52 is of sufficient length to extend completely through respective pin receptacle 42, and may be inserted from either end of pin receptacle 42.

In regard to lifting operation, jack 10 operates as prior art jacks where mechanical reciprocation of jacking mechanism 16 caused pressurized hydraulic fluid (not shown) to create extending force F on ram 14. As force F becomes greater than weight force W of an item to be lifted (not shown) applied to jack shoe 17, ram 14 moves incrementally from a recessed position substantially within housing 12 and jack shoe 17 is close to housing upper surface 20, to an extended position where distance D, between jack shoe 17 and housing upper surface 20, is greater. As ram 14 extends from housing 12, prop 40 extends from storage wells 22, exposing pin receptacles 42. As the desired distance D is reached jacking is continued until the next corresponding pair of pin receptacles 42 is completely accessible to pin shafts 52. At this point jacking may be halted and pin 50 may be inserted into pin receptacles 42 adjacent to housing upper surface 20. Slight lowering operation of jacking mechanism 16 results in a slight retraction of lifting arm 14 and prop 40. Properly engaged in pin receptacles 42, pin 50 disables lowering operation of jacking mechanism 16, which prevents significant retraction of ram 14 by biasing between prop 40 and housing upper surface 20, restricting the decrease in distance D. In this fashion, if lifting force F on ram 14 decreases to less than the force W of the weight of the lifted item (not shown), retractive motion and recessing travel of ram 14 is prohibited by the biasing of pin 50 in prop 40 against housing upper surface 20.

To affect lowering of jack 10, lifting operation in jacking mechanism 16 may need to be actuated to increase lifting force F on ram 14 to be greater or equal to the force W of the weight of the lifted item (not shown) in order to ensure pin 50 is no longer biased between pin receptacles 42 of prop 40 and housing upper surface 20. In the absence of biasing, pin 50 may be removed from prop 40 by withdrawing pin shafts 52 from pin receptacles 42. With pin 50 removed, jack 10 may be lowered by an appropriate manner, as known to the prior art.

Figure 3:
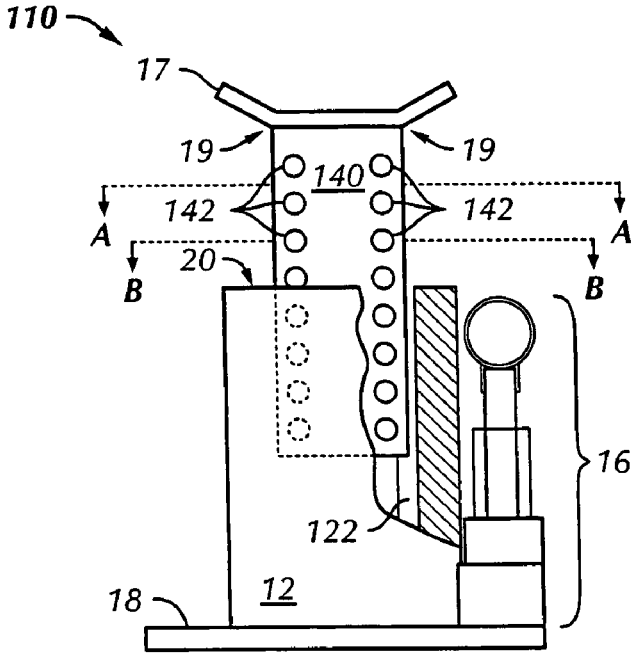
FIG. 3 is a partially cut-away frontal view of a bottle jack according to an alternate exemplary embodiment of the present invention.
Figure 3A:
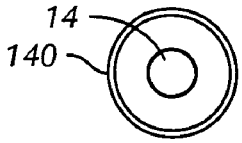
FIG. 3A is a cross-sectional view of the device in FIG. 3, cut at line A—A.
Figure 3B:
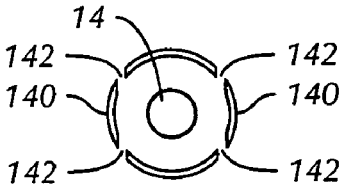
FIG. 3B is a cross-sectional view of the device in FIG. 3, cut at line B—B.

Referring to FIGS. 3, 3A, and 3B, an alternate exemplary jack 110 may have prop 140 attached to ram 14 proximate jack shoe interface 19. Prop 140 is attached to ram 14 and positioned to travel between a retracted position and an extended position in conjunction with ram 14. In FIGS. 3, 3A, and 3B, exemplary prop 140 has a generally cylindrical shape, with ram 14 interior to prop 140, and prop 140 oriented generally parallel to the sides of ram 14. The connection of prop 140 to jack shoe interface 19 may rotate in order to permit prop 140 rotational movement about ram 14 independent of movement of ram 14 or jack shoe 17. Prop 140 may be correspondingly recessable into storage well 122 in jack housing 12, such that prop 140 and ram 14 may similarly and correspondingly both extend from and recess into jack housing 12.

Figure 3C:
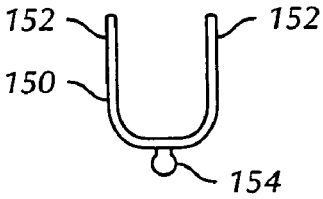
FIG. 3C is a top view of a pin for use with the device depicted in FIG. 3.

Prop 140 possesses a series of pin receptacles 142 arranged spaced apart along the length of each component of prop 140 from the end recessed in housing 12 to the end adjacent jack shoe 17. Referring to FIGS. 3, 3B, and 3C, exemplary receptacles 142 are configured to permit the engagement with pin 150. In the exemplary embodiment pin 150 is comprised of a pair of pin shafts 152 that extend in one direction with a pin handle 154 extending in the opposite direction. Pin 150 possesses a corresponding shape suited to engage corresponding pin receptacles 142 on prop 140. In the exemplary embodiment a pin receptacle 142 in one side of prop 140 and a corresponding pin receptacle 142 in the other side of prop 140 are coordinatingly positioned along prop 140 in order to extend a similar distance above housing upper surface 20 such that each of the pair of pin receptacles 142 may receive a corresponding pin shaft 152. In the exemplary embodiment, each pin shaft 152 is of sufficient length to extend completely through respective pin receptacle 142, and may be inserted from either end of pin receptacle 142.

In an exemplary embodiment having a pivotal connection at jack shoe interface 19, prop 140 may be rotated around internal ram 14 while weight in on jack shoe 17, in order to make insertion of pin 150 into pin receptacle 142 more convenient for an operator.

Figure 4A:
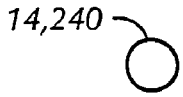
FIG. 4A is a cross-sectional view of the device in FIG. 4, cut at line A—A.
Figure 4B:
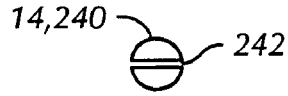
FIG. 4B is a cross-sectional view of the device in FIG. 4, cut at line B—B.
Figure 4:
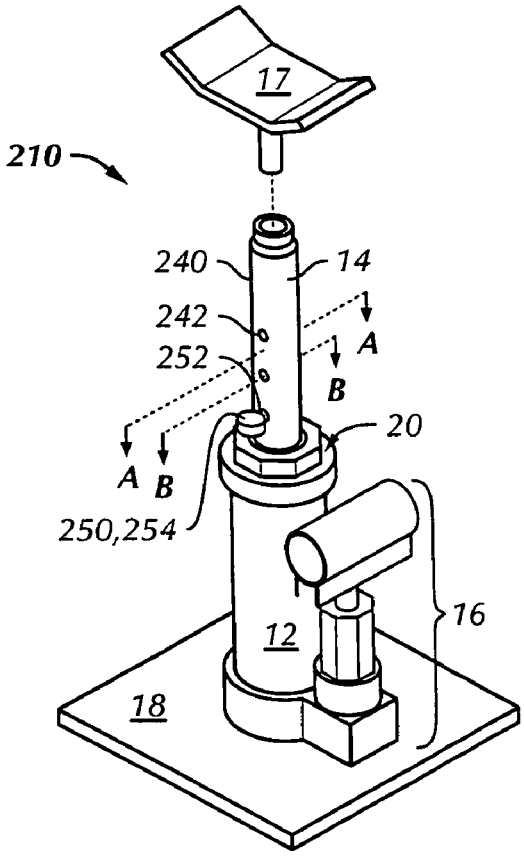
FIG. 4 is a perspective view of a bottle jack according to an alternate exemplary embodiment of the present invention.

Referring to FIGS. 4, 4A, and 4B, additional alternate exemplary jack 210 may have prop 240 integrated with ram

14. As known in the field, one end of ram 14 may be recessed into jack housing 12, while the other end of ram 14 and a length of ram 14 may extend from jack housing 12. The length of ram 14 that may extend from jack housing 12 may be referred to as prop 240.

Prop 240 contains at least one pin receptacle 242. In the exemplary embodiment multiple pin receptacles 242 are spaced apart along the length of ram 14 that may extend from housing 12. Pin receptacles 242 may be configured to permit selective insertion of pin 250. In the exemplary embodiment pin 250 is comprised of a single of pin shafts 252 that extend in one direction with a pin handle 254 extending in the opposite direction. Pin 250 possesses a corresponding shape suited to engage corresponding pin receptacles 242 on prop 240, and may be inserted from either end of pin receptacle 242.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A safety jack comprising:
a jack housing, a lifting arm, and a prop;
said housing having an upper surface;
said lifting arm attached to said housing;
said lifting arm having a center axis;
said prop being elongated and oriented generally parallel with, and adjacent to, said lifting arm;
said lifting arm and said prop jointly movable along said lifting arm center axis;
said lifting arm and said prop controllably extendable away from and retractable toward said housing upper surface;
said prop having at least one pin receptacle adjacent to said lifting arm; and
a pin selectively engagable with said at least one pin receptacle such that retractive motion of said prop biases an engaged said pin between said upper surface and an engaged said at least one pin receptacle.

2. The safety jack of claim 1, wherein:
said prop protruding perpendicularly from said lifting arm.

3. The safety jack of claim 1, wherein:
said at least one pin receptacle being a transverse perforation in said prop.

4. The safety jack of claim 1, wherein:
said prop attached to said lifting arm distal said jack housing.

5. The safety jack of claim 4, wherein:
said prop having a generally cylindrical shape; and
said lifting arm interior to said prop.

6. The safety jack of claim 5, wherein:
said prop rotatably attached to said lifting arm.

7. The safety jack of claim 6, wherein:
said at least one pin receptacle being a transverse perforation in said prop.

8. The safety jack of claim 1, wherein:
said at least one pin receptacle being a plurality of pin receptacles; and
said plurality of pin receptacles spaced apart along said prop.

9. The safety jack of claim 8, wherein:
each said at least one pin receptacle being a transverse perforation in said prop.

10. The safety jack of claim 1, wherein:
said lifting arm telescopically attached to said housing; and
said lifting arm extendable outwardly from said upper surface.

11. The safety jack of claim 1, further comprising:
said housing having a storage well for receiving said prop.

12. A safety jack comprising:
a jack housing, a lifting arm, and a prop;
said housing having an upper surface;
said lifting arm attached to said housing;
said lifting arm having a center axis;
said prop attached to said lifting arm distal said jack housing;
said prop being elongated and oriented generally parallel with, and adjacent to, said lifting arm;
said lifting arm and said prop jointly controllably extendable away from and retractable toward said housing upper surface along said lifting arm center axis;
said prop having at least one pin receptacle; and
a pin selectively engagable with said at least one pin receptacle such that retractive motion of said prop biases an engaged said pin between said upper surface and an engaged said at least one pin receptacle.

13. The safety jack of claim 12, wherein:
said at least one pin receptacle being a transverse perforation in said prop.

14. The safety jack of claim 12, wherein:
said lifting arm telescopically attached to said housing; and
said lifting arm extendable outwardly from said upper surface.

15. The safety jack of claim 12, further comprising:
said housing having a storage well for receiving said prop.

16. The safety jack of claim 12, wherein:
said prop having a generally cylindrical shape; and
said lifting arm interior to said prop.

17. The safety jack of claim 16, wherein:
said prop rotatably attached to said lifting arm.

18. A safety jack having a jacking mechanism, a jack base, a jack housing, and a lifting arm, said safety jack comprising:
said jack housing having a bottom and a top;
said jack base attached to said jack housing bottom;
said lifting arm having a center axis;
said lifting arm telescopically attached to said jack housing;
a prop;
said prop attached to said lifting arm distal said jack housing;
said jacking mechanism having a lifting operation and a lowering operation, each consisting of movement along said lifting arm center axis;
said lifting arm and said prop jointly extendable outwardly from said jack housing top in said lifting operation;
said lifting arm and said prop jointly retractable inwardly toward said jack housing top in said lowering operation;
said housing having a storage well for receiving said prop;
a pin;
said prop having at least one pin receptacle for selectively receiving said pin; and
each said pin receptacle configured to bias a selectively received said pin against said jack housing top in order to selectively disable said lowering operation.

* * * * *